US009196450B2

(12) United States Patent
Liu et al.

(10) Patent No.: US 9,196,450 B2
(45) Date of Patent: Nov. 24, 2015

(54) X-RAY TUBE

(71) Applicants: Tsinghua University, Beijing (CN); HON HAI PRECISION INDUSTRY CO., LTD., New Taipei (TW)

(72) Inventors: Peng Liu, Beijing (CN); Bing-Chu Du, Beijing (CN); Duan-Liang Zhou, Beijing (CN); Chun-Hai Zhang, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 139 days.

(21) Appl. No.: 13/798,780

(22) Filed: Mar. 13, 2013

(65) Prior Publication Data

US 2014/0185777 A1 Jul. 3, 2014

(30) Foreign Application Priority Data

Dec. 29, 2012 (CN) ..... 2012 2 0748145 U

(51) Int. Cl.
*H01J 35/06* (2006.01)

(52) U.S. Cl.
CPC ..... *H01J 35/065* (2013.01); *H01J 2201/30469* (2013.01)

(58) Field of Classification Search
CPC ..... H01J 35/065
USPC ..... 378/122, 136
See application file for complete search history.

(56) References Cited

U.S. PATENT DOCUMENTS

2010/0329429 A1* 12/2010 Okunuki et al. ..... 378/122
2012/0027177 A1* 2/2012 Ogata et al. ..... 378/95
2012/0276669 A1* 11/2012 Wei et al. ..... 438/29

* cited by examiner

*Primary Examiner* — Hoon Song
(74) *Attorney, Agent, or Firm* — Novak Druce Connolly Bove + Quigg LLP

(57) ABSTRACT

An X-ray tube includes a vacuum tube. A field emission cathode structure and an anode spaced from each other are located in the vacuum tube. The field emission cathode structure includes a first metal plate, a second metal plate, and an electron emitter. The electron emitter is fixed between the first metal plate and the second metal plate. One end of the electron emitter extends out of the first metal plate and the second metal plate to act as an electron emission end.

17 Claims, 20 Drawing Sheets

X-RAY TUBE

RELATED APPLICATIONS

This application claims all benefits accruing under 35 U.S.C. §119 from China Patent Application No. 201220748145.6, filed on Dec. 29, 2012 in the China Intellectual Property Office, the disclosure of which is incorporated herein by reference.

BACKGROUND

1. Technical Field

The present application relates to an X-ray tube.

2. Discussion of Related Art

A conventional X-ray tube includes a cathode and an anode, wherein the cathode and the anode are in a vacuum tube. The cathode could be a field emission cathode device. In particular, the carbon nanotube-based field emission cathode has attracted much attention in recent years.

A method for making field emission cathode device usually includes the steps of: providing an insulating substrate; forming a cathode electrode on the substrate; forming a dielectric layer on the cathode electrode; and depositing a plurality of carbon nanotubes on the exposed cathode electrode as the electron emitter by a chemical vapor deposition (CVD) method.

However, the plurality of carbon nanotubes fabricated by the CVD method cannot be secured on the cathode electrode. The plurality of carbon nanotubes is prone to be pulled out from the cathode electrode by a strong electric field force, thus causing the field emission cathode device to have a short lifespan, further causing the X-ray tube to have a short lifespan.

What is needed, therefore, is to provide an X-ray tube that can overcome the above-described shortcomings.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
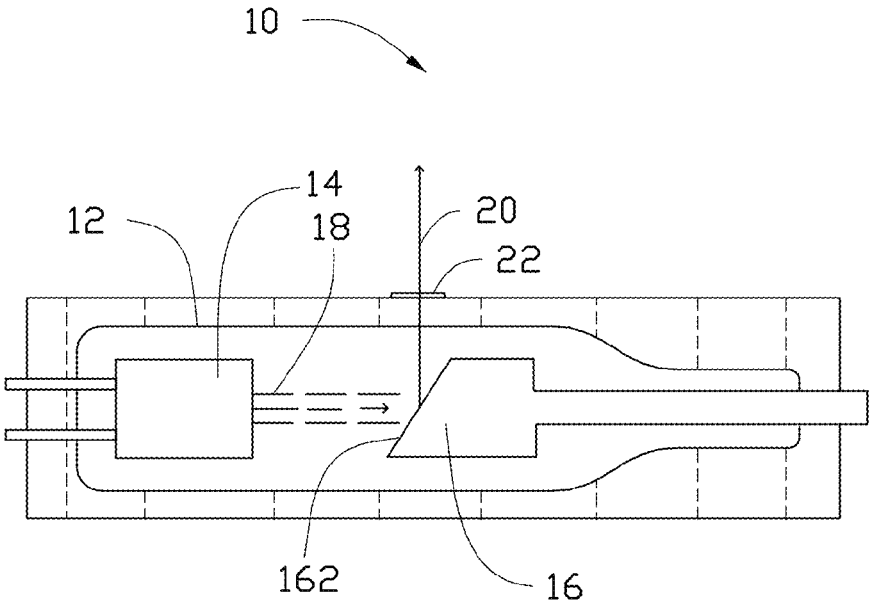
FIG. 1 is a schematic view of one embodiment of an X-ray tube.

Referring to FIG. 1, an X-ray tube 10 includes a vacuum tube 12, a field emission cathode structure 14, and an anode 16. A window 22 is located on a wall of the vacuum tube 12. The field emission cathode structure 14 and the anode 16 are located in the vacuum tube 12, wherein the field emission cathode structure 14 and the anode 16 are spaced from each other. The field emission cathode structure 14 and the anode 16 can be fixed in the vacuum tube 12 by adhesive or sealing or welding. The anode 16 can be made of metal, such as rhodium, silver, tungsten, molybdenum, chromium, palladium, and gold.

In operation, an electron beam 18 from the field emission cathode structure 14 emits to a surface 162 of the anode 16. Thus, an X-ray 20 is obtained by interaction of the electrons of the electron beam 18 with the anode 16. The surface 162 of the anode 16 adjacent to the field emission cathode structure 14 tilts to the window 22. The X-ray 20 emitting to the surface 162 of the anode 16 emits to the window 22.

Figure 2A:
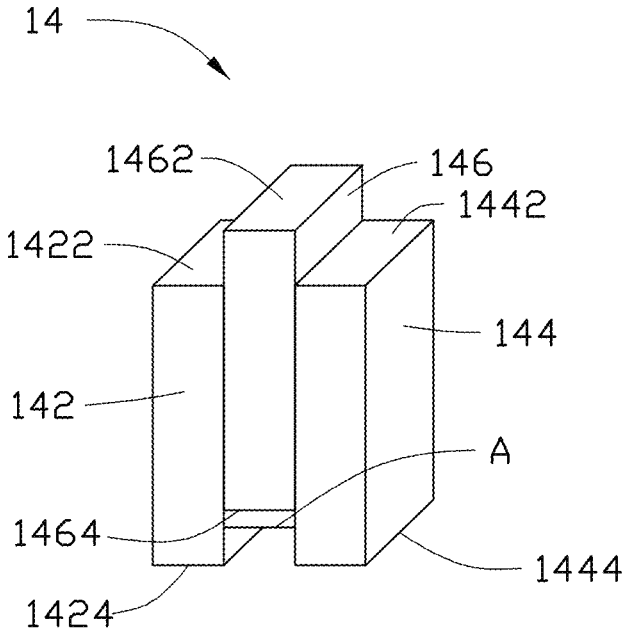
FIG. 2A is a schematic view of one embodiment of a field emission cathode structure.
Figure 2B:
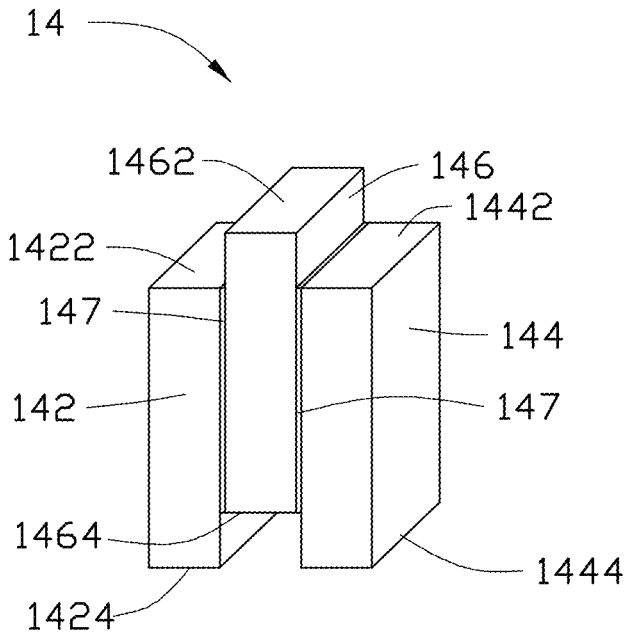
FIG. 2B is a schematic view of another embodiment of the field emission cathode structure.

Referring to FIGS. 2A and 2B, the field emission cathode structure 14 includes a first metal plate 142, a second metal plate 144 and an electron emitter 146. The first metal plate 142 and the second metal plate 144 are spaced from each other and electrically connected to the electron emitter 146. The electron emitter 146 is held and fixed by the first metal plate 142 and the second metal plate 144. The first metal plate 142 has a first end 1422 and a second end 1424 opposite to the first end 1422. The second metal plate 144 has a third end 1442 and a fourth end 1444 opposite to the third end 1442. The electron emitter 146 has a terminal end 1464 and an electron emission end 1462 opposite to the terminal end 1464. The electron emitter 146 extends out of the first metal plate 142 and the second metal plate 144. Therefore, the electron emission end 1462 of the electron emitter 146 is away from the first metal plate 142 and the second metal plate 144, and adjacent to the surface 162 of the anode 16.

The vacuum tube 12 can be made of ceramic or glass. In one embodiment, the vacuum tube 12 is made of glass. The vacuum tube 12 is vacuum-pumped.

The first metal plate 142 and the second metal plate 144 can be gold, silver, copper, aluminum, Ni, steel, Fe, Mo, Ti, Zr, Pd, W, Ta, or any alloy of the metal mentioned. The first metal plate 142 and the second metal plate 144 can be the same metal or different metals. A shape and a thickness of the first metal plate 142 and the second metal plate 144 can be chosen according to need. For example, the shape of the first metal plate 142 and the second metal plate 144 can be square or rectangular with a thickness greater than 15 micrometers. The shape of the first metal plate 142 and the second metal plate 144 can be "L" shape, such that the stability of the field emission cathode structure 14 can be improved. In one embodiment, the material of the first metal plate 142 and the second metal plate 144 is copper, and the shape of the first metal plate 142 and the second metal plate 144 is square shaped with a side length of about 50 millimeters and a thickness of about 1 millimeter.

The electron emitter 146 can be held and fixed between the first metal plate 142 and the second metal plate 144 by welding the first metal plate 142 and the second metal plate 144 together or by an adhesive layer 147.

In detail, referring to FIG. 2A, the terminal end 1464 of the electron emitter 146 is between the first metal plate 142 and the second metal plate 144, and does not extend out of the second end 1424 of the first metal plate 142 and the fourth end 1444 of the second metal plate 144. A portion of the first metal plate 142 contacts with the electron emitter 146, and a portion of the second metal plate 144 contacts with the electron emitter 146. In order to fix but not destroy the electron emitter 146, the other portion of the first metal plate 142 away from the electron emitter 146 and the other portion of the second metal plate 144 away from the electron emitter 146 are welded together. Letter A represents a position of welding, as shown in FIG. 2A.

Referring to FIG. 2B, the first metal plate 142 is attached to the electron emitter 146 by the adhesive layer 147. The second metal plate 144 is attached to the electron emitter 146 by the adhesive layer 147. The electron emitter 146 can be tightly adhered between the first metal plate 142 and the second metal plate 144 by the adhesive layer 147. A material of the adhesive layer 147 can be a heat-resistant adhesive such as epoxy adhesive, conductive paste.

A length of the electron emitter 146 extending out of the first metal plate 142 and the second metal plate 144 can be in a range from about 5 micrometers to about 1 millimeter. In one embodiment, the length of the electron emitter 146 extending out of the first metal plate 142 and the second metal plate 144 is in a range from about 20 micrometers to about 500 micrometers. A thickness of the electron emitter 146 can be in a range from about 10 micrometers to about 1 millimeter. In one embodiment, the thickness of the electron emitter 146 is in a range from about 30 micrometers to about 200 micrometers. In one embodiment, the length of the electron emitter 146 extending out of the first metal plate 142 and the second metal plate 144 is 500 micrometers, the thickness of the electron emitter 146 is 100 micrometers.

The electron emitter 146 includes a plurality of carbon nanotubes uniformly distributed therein. The plurality of carbon nanotubes can be combined by van der Waals attractive force. The electron emitter 146 can be a substantially pure structure of the carbon nanotubes, with few impurities. The plurality of carbon nanotubes may be single-walled, double-walled, multi-walled carbon nanotubes, or their combinations. The carbon nanotubes which are single-walled have a diameter of about 0.5 nanometers (nm) to about 50 nm. The carbon nanotubes which are double-walled have a diameter of about 1.0 nm to about 50 nm. The carbon nanotubes which are multi-walled have a diameter of about 1.5 nm to about 50 nm.

The carbon nanotubes in the electron emitter 146 can be orderly or disorderly arranged. The term 'disordered carbon nanotube' refers to the electron emitter 146 where the carbon nanotubes are arranged along many different directions, and the aligning directions of the carbon nanotubes are random. The number of the carbon nanotubes arranged along each different direction can be almost the same (e.g. uniformly disordered). The carbon nanotubes can be entangled with each other.

The term 'ordered carbon nanotube' refers to the electron emitter 146 where the carbon nanotubes are arranged in a consistently systematic manner, e.g., the carbon nanotubes are arranged approximately along a same direction and/or have two or more sections within each of which the carbon nanotubes are arranged approximately along a same direction (different sections can have different directions).

The electron emitter 146 can be a carbon nanotube layer structure including a plurality of drawn carbon nanotube films, a plurality of flocculated carbon nanotube films, or a plurality of pressed carbon nanotube films. The electron emitter 146 can include a plurality of carbon nanotube wire structures 1460 spaced from each other or tightly arranged in parallel. The electron emitter 146 can include one carbon nanotube wire structure 1460, wherein a diameter of the carbon nanotube wire structure 1460 can be greater than or equal to 100 micrometers. In one embodiment, if the electron emitter 146 includes one carbon nanotube wire structure 1460, the diameter of the carbon nanotube wire structure 1460 is greater than or equal to 1 millimeter.

Figure 3:
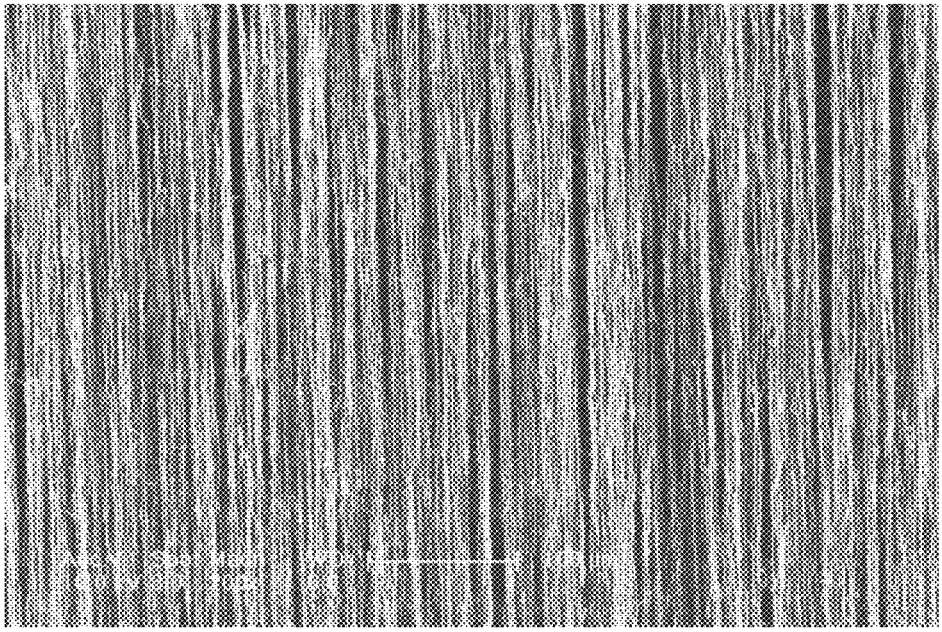
FIG. 3 is a scanning electron microscope (SEM) image of a drawn carbon nanotube film.

Referring to FIG. 3, the drawn carbon nanotube film includes a plurality of successive and oriented carbon nanotubes joined end-to-end by van der Waals attractive force therebetween. The carbon nanotubes in the drawn carbon nanotube film are oriented along a preferred orientation. The carbon nanotubes are parallel to a surface of the drawn carbon nanotube film. The drawn carbon nanotube film is a free-standing film. The drawn carbon nanotube film can bend to desired shapes without breaking. A film can be drawn from a carbon nanotube array to form the drawn carbon nanotube film.

If the electron emitter 146 includes at least two stacked drawn carbon nanotube films, adjacent drawn carbon nanotube films can be combined by only the van der Waals attractive force therebetween. Additionally, when the carbon nanotubes in the drawn carbon nanotube film are aligned along one preferred orientation, an angle can exist between the orientations of carbon nanotubes in adjacent drawn carbon nanotube films, whether stacked or adjacent. An angle between the aligned directions of the carbon nanotubes in two adjacent drawn carbon nanotube films can be in a range from about 0 degree to about 90 degrees. Stacking the drawn carbon nanotube films will improve the mechanical strength of the electron emitter 146, further improving the lifespan of the X-ray tube 10. In one embodiment, the electron emitter 146 includes 1000 layers of the drawn carbon nanotube films, and the angle between the aligned directions of the carbon nanotubes in two adjacent drawn carbon nanotube films is about 90 degrees. In one embodiment, the thickness of the electron emitter 146 is about 100 micrometers, and the length of the electron emitter 146 is about 5 millimeters.

Figure 4:
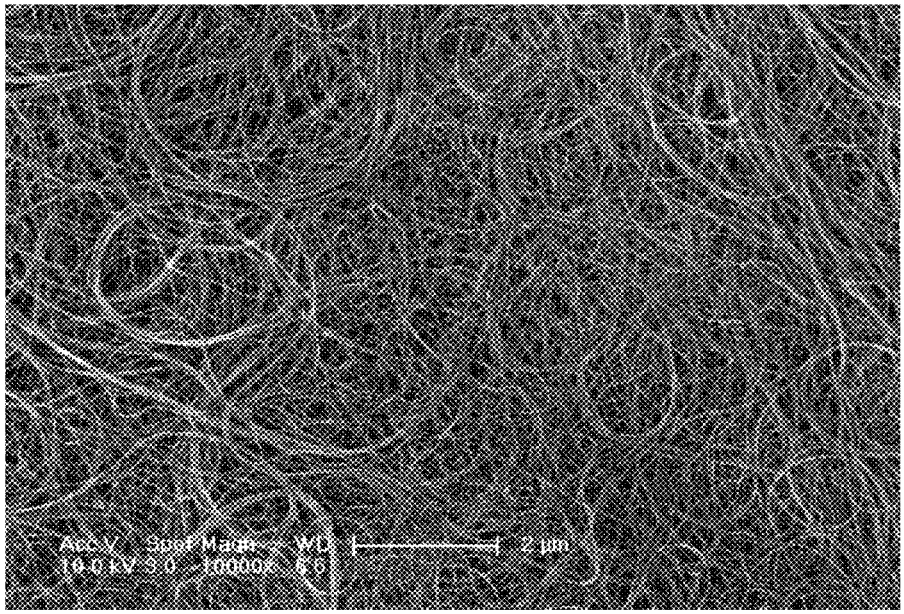
FIG. 4 is an SEM image of a flocculated carbon nanotube film.

Referring to FIG. 4, the flocculated carbon nanotube film includes a plurality of long, curved, disordered carbon nanotubes entangled with each other. The flocculated carbon nanotube film can be isotropic. The carbon nanotubes can be substantially uniformly dispersed in the flocculated carbon nanotube film. Adjacent carbon nanotubes are acted upon by van der Waals attractive force to obtain an entangled structure. Due to the carbon nanotubes in the flocculated carbon nanotube film being entangled with each other, the flocculated carbon nanotube film has excellent durability, and can be fashioned into desired shapes with a low risk to the integrity of the flocculated carbon nanotube film. Further, the flocculated carbon nanotube film is a free-standing film.

Figure 5:
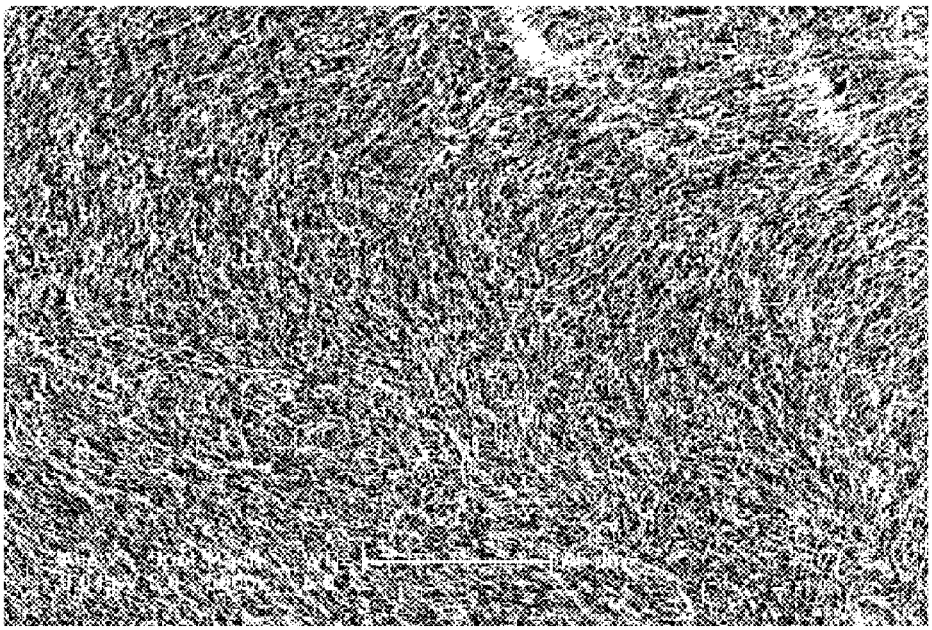
FIG. 5 is an SEM image of a pressed carbon nanotube film including a plurality of carbon nanotubes arranged along a same direction.
Figure 6:
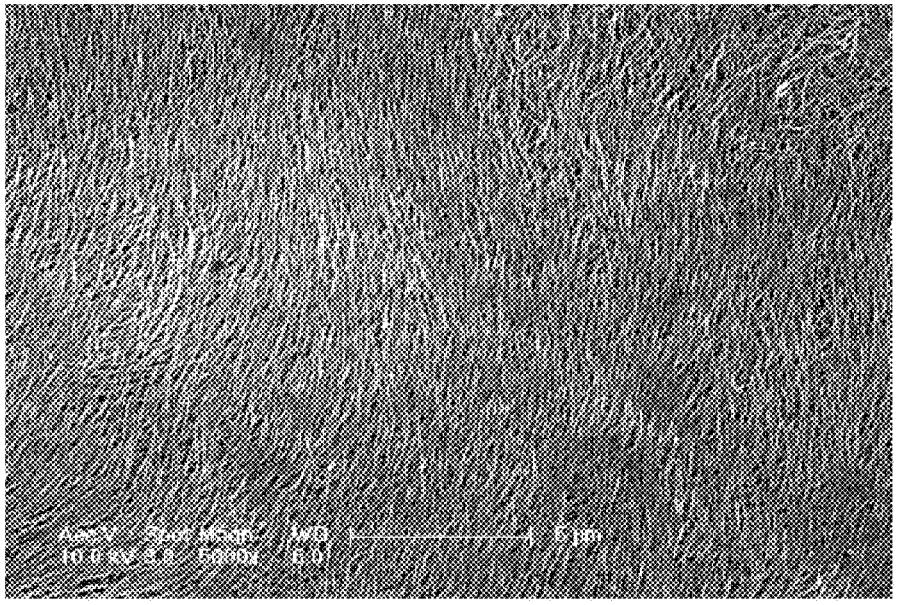
FIG. 6 is an SEM image of a pressed carbon nanotube film including a plurality of carbon nanotubes which is arranged along different direction.

Referring to FIGS. 5 and 6, the pressed carbon nanotube film includes a plurality of carbon nanotubes. The carbon nanotubes in the pressed carbon nanotube film can be arranged along a same direction, as shown in FIG. 5. The carbon nanotubes in the pressed carbon nanotube film can be arranged along different directions, as shown in FIG. 6. The carbon nanotubes in the pressed carbon nanotube film can rest upon each other. An angle between a primary alignment direction of the carbon nanotubes and a surface of the pressed carbon nanotube film is about 0 degree to approximately 15 degrees. The greater the pressure applied, the smaller the angle obtained. If the carbon nanotubes in the pressed carbon nanotube film are arranged along different directions, the pressed carbon nanotube film can have properties that are identical in all directions substantially parallel to the surface of the pressed carbon nanotube film. Adjacent carbon nanotubes are attracted to each other and are joined by van der Waals attractive force. Therefore, the pressed carbon nanotube film is easy to bend to desired shapes without breaking. Further, the pressed carbon nanotube film is a free-standing film.

The term "free-standing" includes, but not limited to, the carbon nanotube layer structure that does not have to be supported by a substrate. For example, the free-standing carbon nanotube layer structure can sustain the weight of itself when it is hoisted by a portion thereof without any significant damage to its structural integrity. So, if the free-standing carbon nanotube layer structure is placed between two separate supporters, a portion of the free-standing carbon nanotube layer structure, not in contact with the two supporters, would be suspended between the two supporters and yet maintain film structural integrity.

Figure 7:
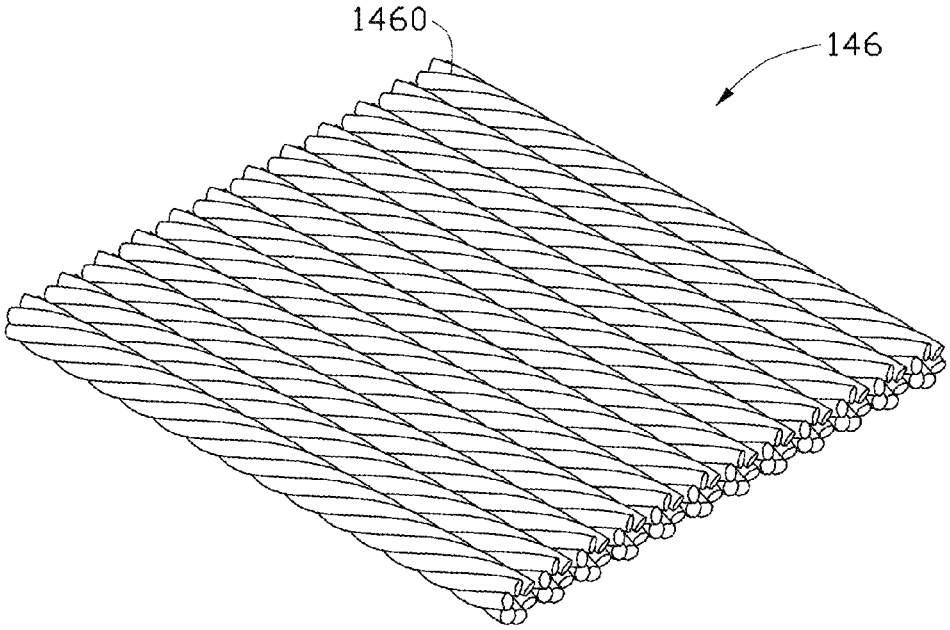
FIG. 7 is a schematic view of one embodiment of an electron emitter.
Figure 8:
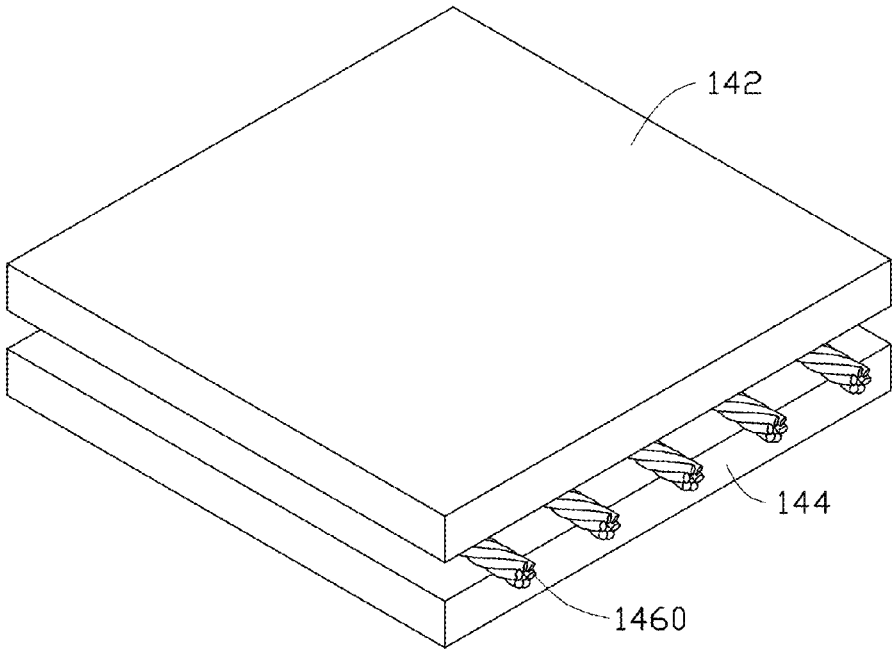
FIG. 8 is another schematic view of one embodiment of the electron emitter.

Referring to FIG. 7, the electron emitter 146 includes a plurality of carbon nanotube wire structures 1460 tightly arranged in parallel. There is no space between two adjacent carbon nanotube wire structures 1460. Referring to FIG. 8, the electron emitter 146 includes a plurality of carbon nanotube wire structures 1460 arranged in parallel. The plurality of carbon nanotube wire structures 1460 is spaced from each other.

Figure 9:
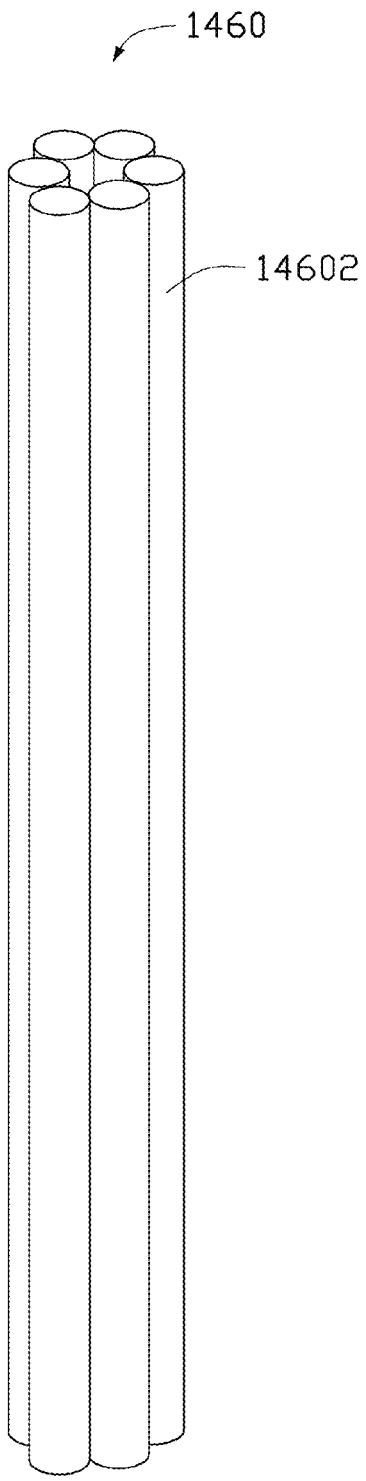
FIG. 9 is a schematic view of one embodiment of a carbon nanotube wire structure.
Figure 10:
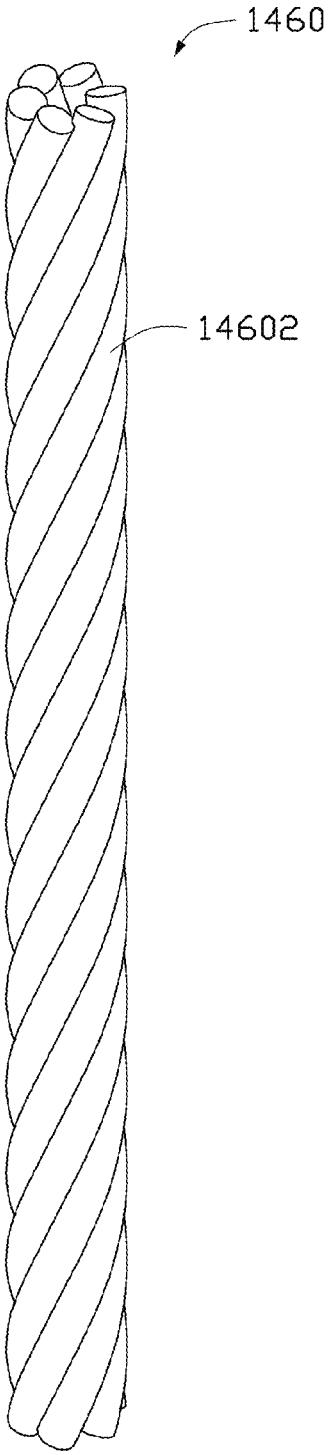
FIG. 10 is another schematic view of one embodiment of the carbon nanotube wire structure.

Referring to FIG. 9, the carbon nanotube wire structure 1460 includes a plurality of carbon nanotube wires 14602 substantially parallel with each other. Referring to FIG. 10, the carbon nanotube wire structure 1460 includes a plurality of carbon nanotube wires 14602 twisted with each other.

Figure 11:
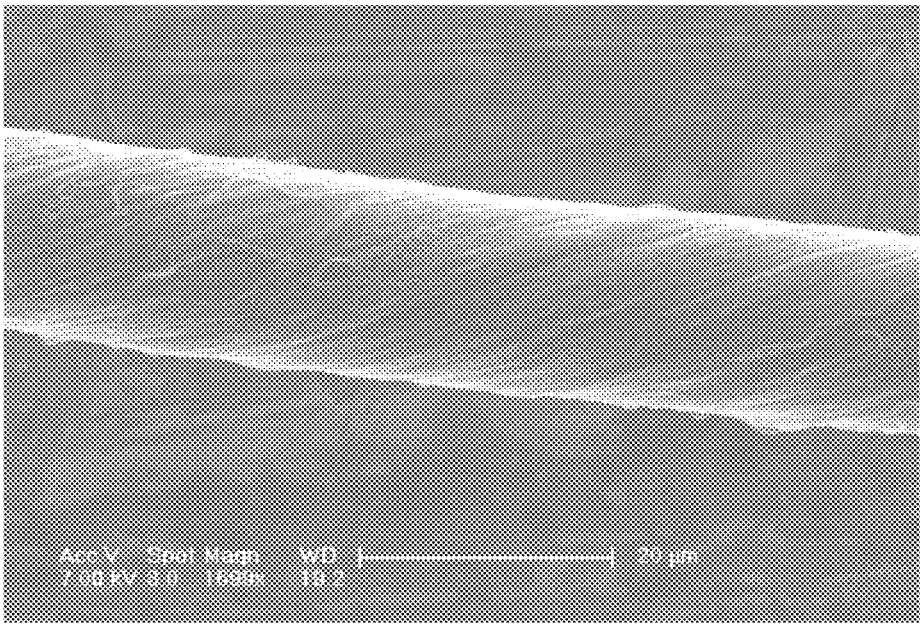
FIG. 11 is an SEM image of a twisted carbon nanotube wire.

The carbon nanotube wire 14602 can be twisted or untwisted. The twisted carbon nanotube wire 14602 can be formed by twisting the drawn carbon nanotube film using a mechanical force to turn the two ends of the drawn carbon nanotube film in opposite directions. Referring to FIG. 11, the twisted carbon nanotube wire 14602 includes a plurality of carbon nanotubes helically oriented around an axial direction of the twisted carbon nanotube wire 14602. A length of the carbon nanotube wire 14602 can be set as desired. In one embodiment, the length of the twisted carbon nanotube wire 14602 can be in a range from about 10 micrometers to about 100 micrometers. A diameter of the twisted carbon nanotube wire 14602 can be in a range from about 0.5 nanometers to about 100 micrometers. Further, the twisted carbon nanotube wire 14602 can be treated with a volatile organic solvent after being twisted. After being soaked by the organic solvent, the adjacent paralleled carbon nanotubes in the twisted carbon nanotube wire 14602 will bundle together. The specific surface area of the twisted carbon nanotube wire 14602 will decrease, while the density and strength of the twisted carbon nanotube wire 14602 will increase. The carbon nanotubes in the carbon nanotube wire 14602 can be single-walled, double-walled, or multi-walled carbon nanotubes.

Figure 12:
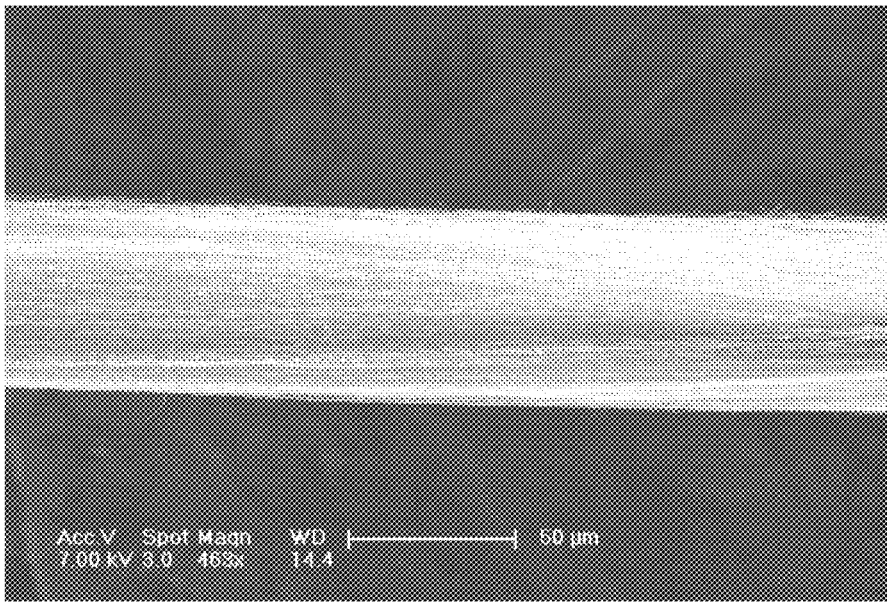
FIG. 12 is an SEM image of an untwisted carbon nanotube wire.

The untwisted carbon nanotube wire 14602 can be obtained by treating the drawn carbon nanotube film drawn from the carbon nanotube array with the volatile organic solvent. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be pulled together to form the untwisted carbon nanotube wire 14602. Referring to FIG. 12, the untwisted carbon nanotube wire 14602 includes a plurality of carbon nanotubes substantially oriented along a same direction (i.e., a direction along the length of the untwisted carbon nanotube wire 14602). The carbon nanotubes are substantially parallel to the axis of the untwisted carbon nanotube wire 14602. More specifically, the untwisted carbon nanotube wire 14602 includes a plurality of successive carbon nanotubes joined end to end by van der Waals attractive force therebetween. A length of the untwisted carbon nanotube wire 14602 can be arbitrarily set as desired. In one embodiment, the length of the untwisted carbon nanotube wire 14602 can be in a range from about 10 micrometers to about 100 micrometers. A diameter of the untwisted carbon nanotube wire 14602 can be in a range from about 0.5 nanometers to about 100 micrometers. In one embodiment, the diameter of the untwisted carbon nanotube wire 14602 is in a range from about 100 nanometers to about 100 micrometers.

Figure 13:
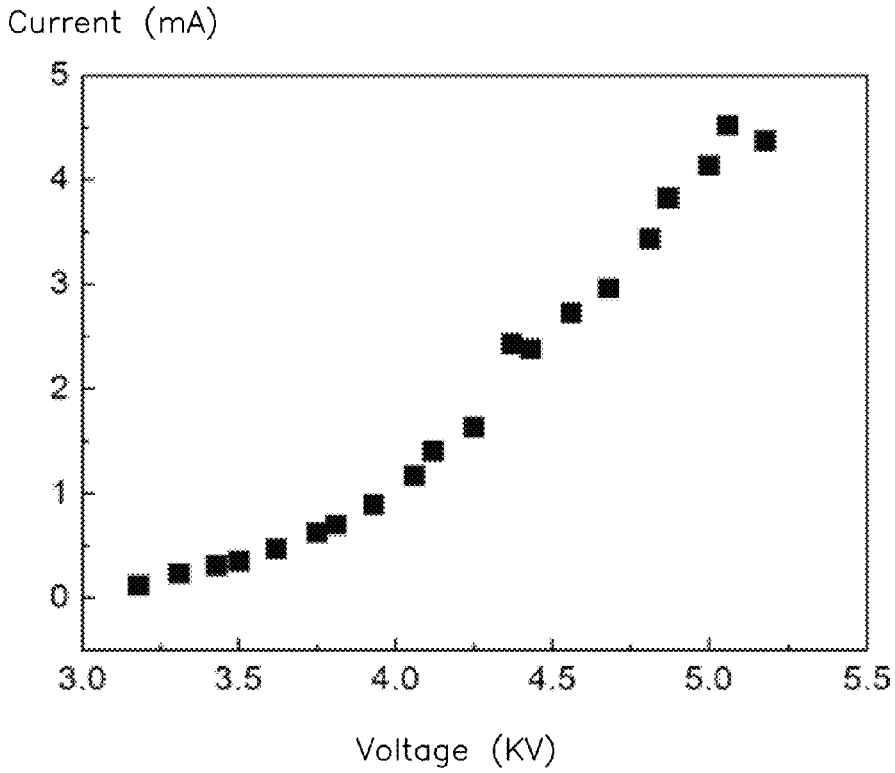
FIG. 13 is a current-voltage curve of one embodiment of the field emission cathode structure of FIG. 2A.
Figure 14:
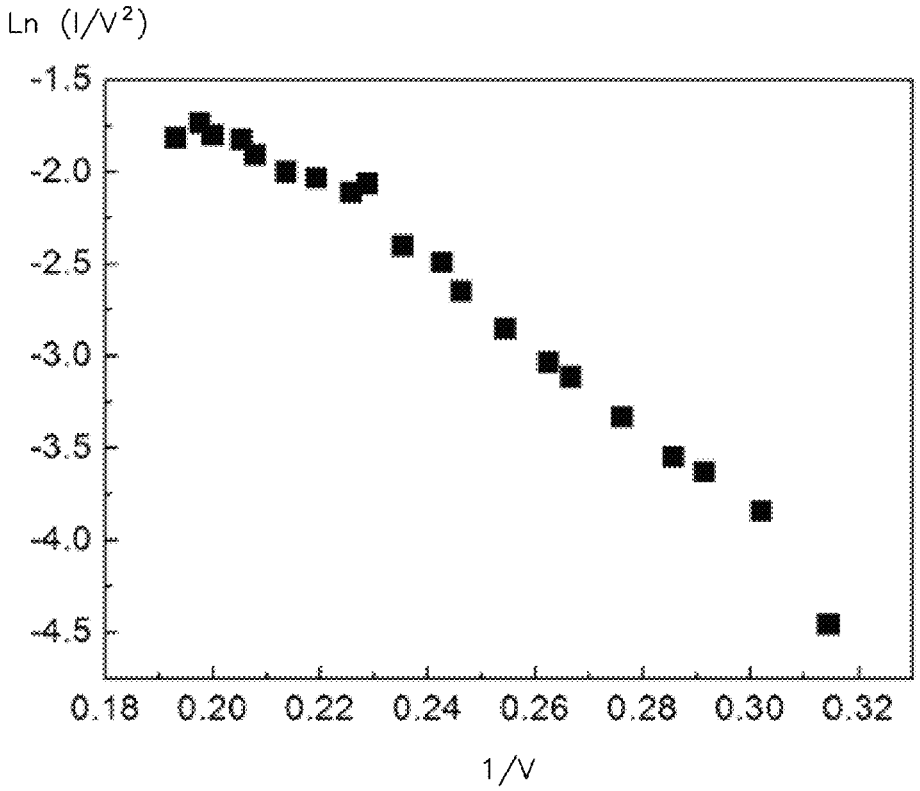
FIG. 14 is a Fowler-Nordheim curve of one embodiment of the field emission cathode structure of FIG. 2A.
Figure 15:
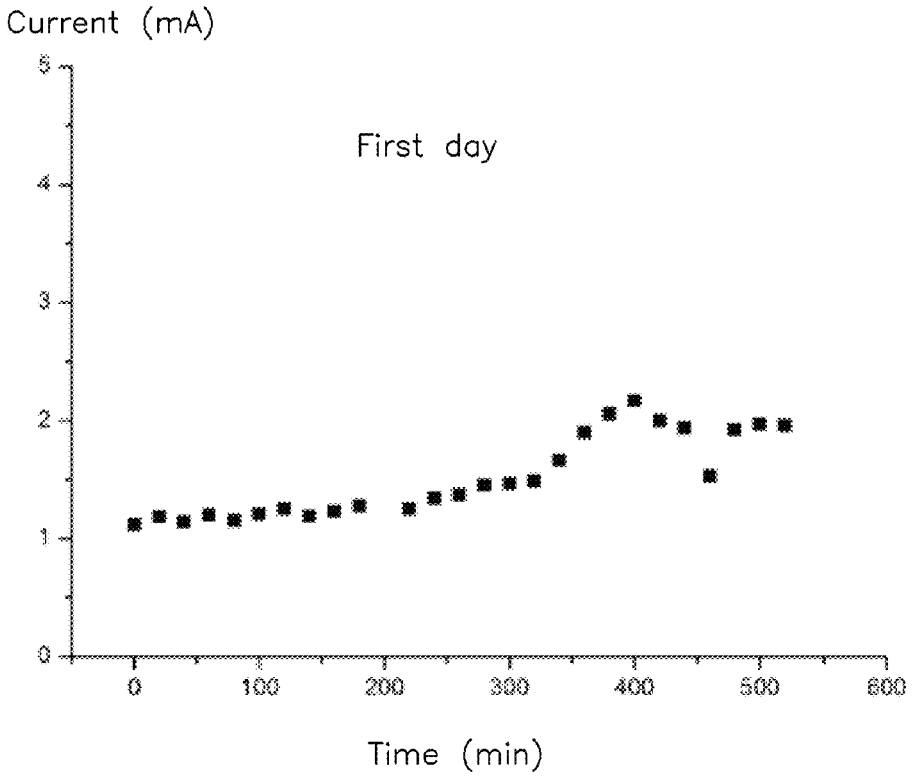
FIG. 15 is a current-time curve of one embodiment of the field emission cathode structure of FIG. 2A at the first day.
Figure 16:
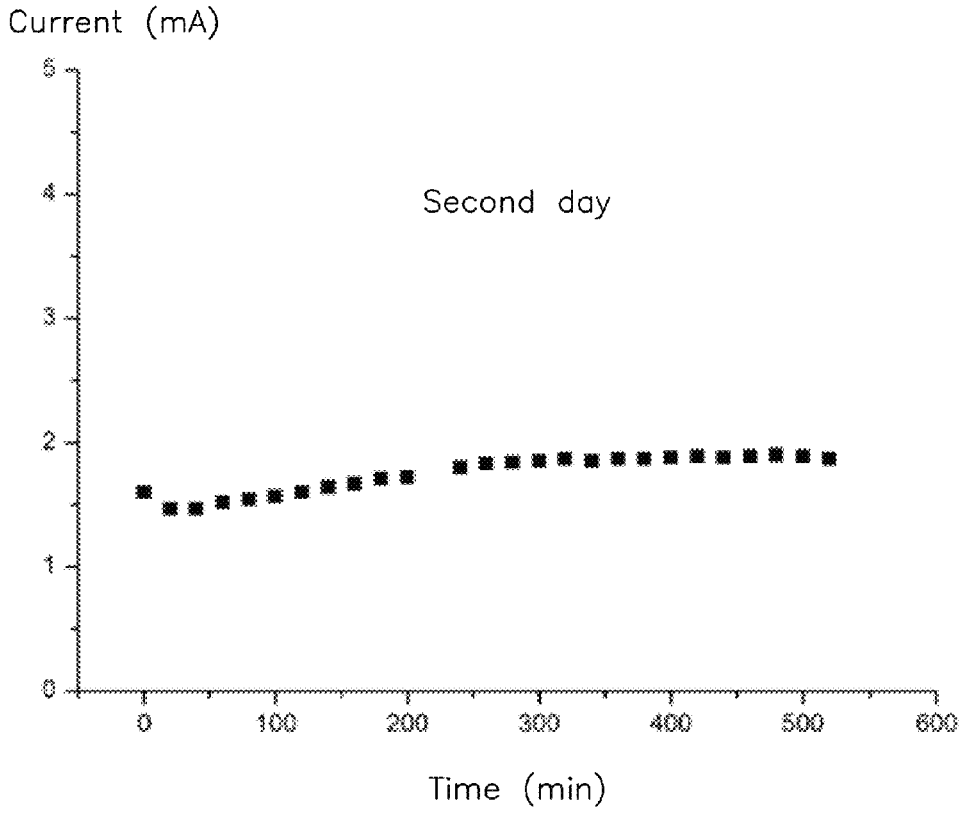
FIG. 16 is a current-time curve of one embodiment of the field emission cathode structure of FIG. 2A at the second day.
Figure 17:
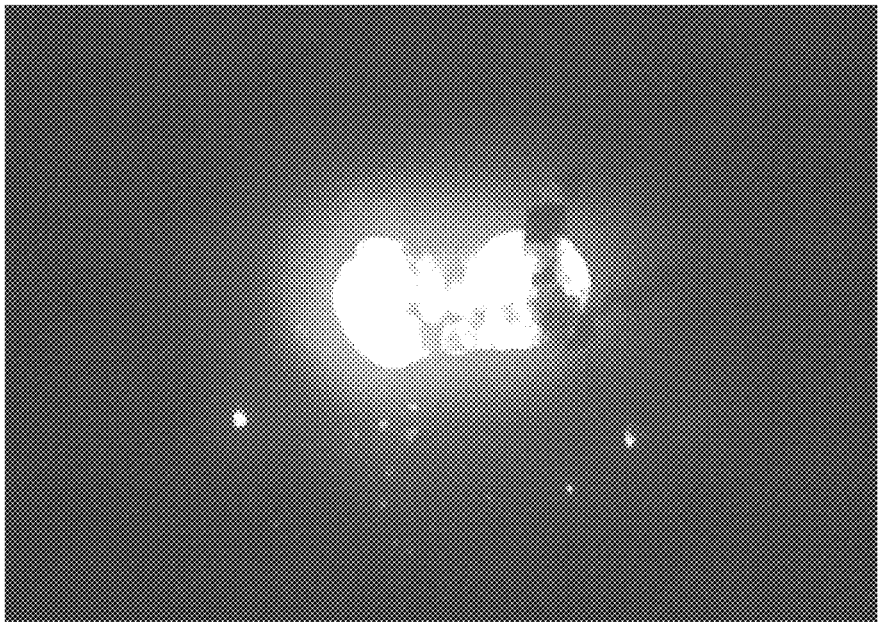
FIG. 17 is an optical image of light emitted by an anode of one embodiment of the X-ray tube of FIG. 1.

FIGS. 13-17 show some characterizations of the electron emitter 146 including 1000 of the drawn carbon nanotube films, wherein the thickness of the electron emitter 146 is about 100 micrometers, and the length of the electron emitter 146 is about 5 millimeters. Referring to FIG. 13, when an emission voltage of the electron emitter 146 is about 5000 volts, an emission current of the electron emitter 146 is about 4.5 milliamperes. Therefore, the electron emitter 146 has a larger emission current density. FIG. 14 shows that the electron emitter 146 has good field emission property. Referring to FIG. 15 and FIG. 16, in the same emission time, a current value of the electron emitter 146 at the first day is substantially equal to a current value of the electron emitter 146 at the second day. Therefore, FIGS. 15 and 16 show that the electron emitter 146 has good emission stability. Referring to FIG. 17, the anode image of one embodiment of the X-ray tube 10 has high and uniform brightness. FIG. 17 shows that the electron emitter 146 has uniform field emission property. The electron emitter 146 has a large emission current density, good emission stabilization and good field emission property, which improve the lifespan of the X-ray tube 10.

Figure 18:
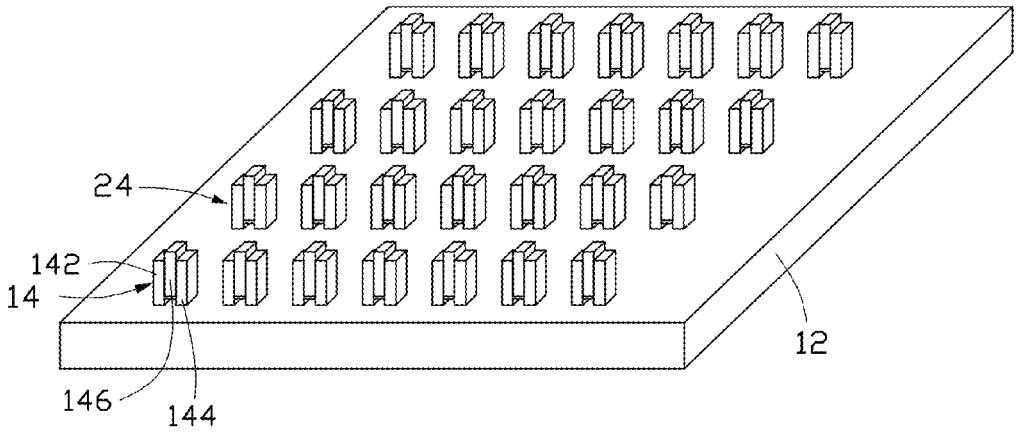
FIG. 18 is a schematic view of another embodiment of a field emission cathode structure.

An embodiment of the X-ray tube 10 is shown in FIG. 18 where the field emission cathode structure 24 includes a plurality of field emission cathode structures 14. The plurality of field emission cathode structures 14 is spaced from each other. A distance between adjacent field emission cathode structures 14 can be set as desired. The emission current of the field emission cathode structure 24 is improved, because the field emission cathode structure 24 includes a plurality of field emission cathode structures 14. Furthermore, the work efficiency of the X-ray tube 10 is improved.

Figure 19:
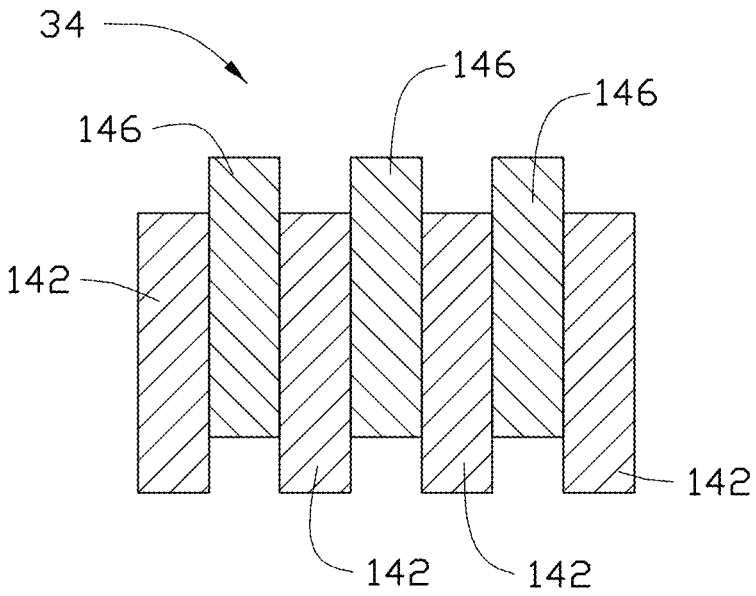
FIG. 19 is a schematic view of yet another embodiment of a field emission cathode structure.

An embodiment of the X-ray tube 10 is shown in FIG. 19 where the field emission cathode structure 34 includes a plurality of first metal plates 142 and a plurality of electron emitters 146. The plurality of first metal plates 142 and the plurality of electron emitters 146 are alternatively stacked. One electron emitter 146 is located between two adjacent first metal plates 142. One first metal plate 142 is located between two adjacent electron emitters 146. The electron emitter 146 extends out of the first metal plate 142. The electron emission end 1462 of the electron emitter 146 is away from the first metal plate 142 and adjacent to the surface 162 of the anode 16. The emission current density of the field emission cathode structure 34 is improved because the field emission cathode structure 34 includes a plurality of emission emitters. Furthermore, work efficiency of the X-ray tube 10 is also improved.

In summary, the electron emitter 146 is fixed between two metal plates, so that the electron emitter 146 can be firmly fixed in the field emission cathode structure 14. Thus, the electron emitter 146 is secured and cannot be pulled out from two metal plates by an electric field force in a strong electric field. Therefore, the field emission cathode structure 14 has a long life, and accordingly, the X-ray tube 10 also has a long life. Furthermore, the first metal plate 142 and the second metal plate 144 have good heat conductivity, thus the first metal plate 142 and the second metal plate 144 in the field emission cathode structure 14 can effectively reduce the process cost. The first metal plate 142 and the second metal plate 144 can also improve the heat dissipation of the electron emitter 146 in application, such that the lifespan of X-ray tube 10 is improved. Additionally, stacking the carbon nanotube layer structures will improve mechanical strength of the electron emitter 146, further improving the lifespan of the X-ray tube 10. Moreover, the X-ray tube 10 is simple and easy to operate.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

It is also to be understood that the above description and the claims drawn to a method may include some indication in reference to certain steps. However, the indication used is only to be viewed for identification purposes and not as a suggestion as to an order for the steps.

What is claimed is:

1. An X-ray tube, comprising:

a vacuum tube; and a field emission cathode structure and an anode spaced from each other and located in the vacuum tube, wherein the field emission cathode structure comprises a first metal plate, a second metal plate, and an electron emitter fixed between the first metal plate and the second metal plate, and one end of the electron emitter extends out of the first metal plate and the second metal plate, to act as an electron emission end; wherein the electron emitter comprises 1000 layers of drawn carbon nanotube films, a thickness of the electron emitter is about 100 micrometers, and a length of the electron emitter is about 5 millimeters.

2. The X-ray tube of claim 1, wherein a length of parts of the electron emitter extending out of the first metal plate and the second metal plate is in a range from about 5 micrometers to about 1 millimeter.

3. The X-ray tube of claim 1, wherein the electron emission end of the electron emitter is adjacent to the anode.

4. The X-ray tube of claim 1, wherein the electron emitter is fixed between the first metal plate and the second metal plate by welding the first metal plate and the second metal plate together.

5. The X-ray tube of claim 4, wherein one end of the first metal plate away from the electron emitter and one end of the second metal plate away from the electron emitter are welded together.

6. The X-ray tube of claim 1, wherein the electron emitter is fixed between the first metal plate and the second metal plate by an adhesive layer.

7. The X-ray tube of claim 6, wherein the adhesive layer is made of a heat-resistant adhesive.

8. The X-ray tube of claim 1, further comprising a plurality of the field emission cathode structures spaced from each other.

9. The X-ray tube of claim 1, wherein the 1000 layers of drawn carbon nanotube films comprise a plurality of successive and oriented carbon nanotubes joined end-to-end by van der Waals attractive force.

10. An X-ray tube, comprising:

a vacuum tube; and a field emission cathode structure and an anode spaced from each other and located in the vacuum tube, wherein the field emission cathode structure comprises a plurality of metal plates and a plurality of electron emitters alternatively stacked, each of the plurality of electron emitters is fixed between two adjacent metal plates, and one end of each of the plurality of electron emitters extends out of each of the plurality of metal plates to act as an electron emission end; wherein each of the plurality of electron emitters comprises 1000 layers of drawn carbon nanotube films, a thickness of the electron emitter is about 100 micrometers, and a length of the electron emitter is about 5 millimeters.

11. The X-ray tube of claim 10, wherein the electron emission end is away from the plurality of metal plates and adjacent to the anode.

12. The X-ray tube of claim 10, wherein the electron emitter is fixed between two adjacent metal plates by welding two adjacent metal plates together.

13. An X-ray tube, comprising:

a vacuum tube; and a field emission cathode structure and an anode spaced from each other and located in the vacuum tube, wherein the field emission cathode structure comprises two metal plates and 1000 layers of drawn carbon nanotube films acting as an electron emitter located between and in contact with the two metal plates, one end of the electron emitter extending out of two metal plates to act as an electron emission end, and a portion of the electron emitter being fixed between two metal plates; wherein a thickness of the 1000 layers of drawn carbon nanotube films is about 100 micrometers, and a length of the 1000 layers of drawn carbon nanotube films is about 5 millimeters.

14. The X-ray tube of claim 1, wherein a portion of the first metal plate directly contacts the electron emitter, and a portion of the second metal plate directly contacts the electron emitter.

15. The X-ray tube of claim 1, wherein the electron emitter is has a rectangle shaped.

16. The X-ray tube of claim 1, wherein the shape of the first metal plate and the second metal plate is square or rectangle with a thickness greater than 15 micrometers.

17. The X-ray tube of claim 1, wherein the shape of the first metal plate and the second metal plate comprises an "L" shape.

* * * * *